United States Patent [19]

Schraudenbach

[11] 4,067,196

[45] Jan. 10, 1978

[54] DECORATIVE STONE

[76] Inventor: Paul Schraudenbach, Schneemannstr. 22, 8000 Munich 70, Germany

[21] Appl. No.: 621,164

[22] Filed: Oct. 9, 1975

[30] Foreign Application Priority Data

Nov. 18, 1974 Germany ..... 2454614

[51] Int. Cl.[2] ..... E02D 17/20; E02B 3/14

[52] U.S. Cl. ..... 61/35; 52/663; 52/581; 52/590; 61/37; 404/36; 404/41

[58] Field of Search ..... 61/37, 2, 3, 4, 47; 52/663, 581, 590; 404/34, 35, 36, 37, 38, 39, 40, 41, 42, 43, 44, 45, 46

[56] References Cited

U.S. PATENT DOCUMENTS

| | | | |
|---|---|---|---|
| 1,953,154 | 4/1934 | Cram | 61/39 |
| 2,777,789 | 1/1957 | Smith | 52/663 |
| 2,786,301 | 3/1957 | Toricilli | 52/590 |
| 3,347,048 | 10/1967 | Brown et al. | 61/37 |
| 3,557,669 | 6/1968 | Fenton | 404/42 |
| 3,597,928 | 8/1971 | Pilaar | 61/4 |
| 3,903,702 | 9/1975 | Appleton | 61/37 |

FOREIGN PATENT DOCUMENTS

| | | | |
|---|---|---|---|
| 162,712 | 4/1949 | Austria | 404/34 |
| 1,377,229 | 9/1964 | France | 52/581 |
| 2,431,708 | 1/1976 | Germany | 404/42 |
| 2,416,547 | 10/1975 | Germany | 404/41 |
| 1,277,174 | 6/1972 | United Kingdom | 61/37 |
| 806,982 | 1/1959 | United Kingdom | 52/581 |

*Primary Examiner*—Robert L. Wolfe
*Assistant Examiner*—A. Grosz
*Attorney, Agent, or Firm*—Craig & Antonelli

[57] ABSTRACT

A decorative stone or tile, preferably for the fortification of sloping surfaces such as embankments, banks, or the like, which consists of parallel ribs and crosspieces extending at right angles to the ribs with several of the ribs projecting beyond the outer crosspieces and several crosspieces projecting beyond the outer ribs. The projecting ends of the ribs and crosspieces are provided with either grooves or tongues corresponding to the grooves. The grooves or tongues are formed respectively by boundary surfaces extending vertically to the stone surface and are arranged in an alternate pattern about the periphery of the stone or tile. At least one extension is provided between the projecting ends of the externally disposed ribs and crosspieces. The extension is shorter than the length of the projecting ends of the ribs and crosspieces. The extension includes an end face which extends parallel to the vertical plane in which the crosspieces and/or ribs extend.

48 Claims, 14 Drawing Figures

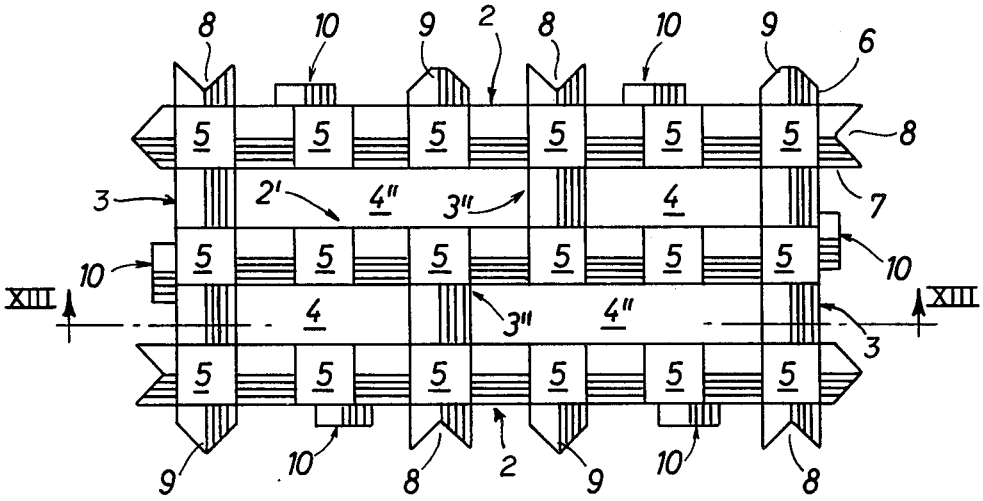
FIG. 4
FIG. 5
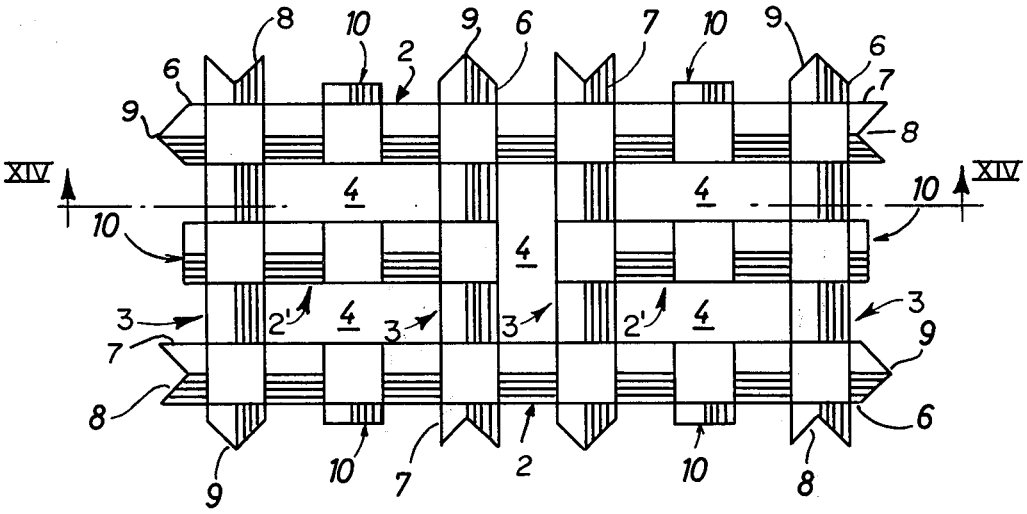

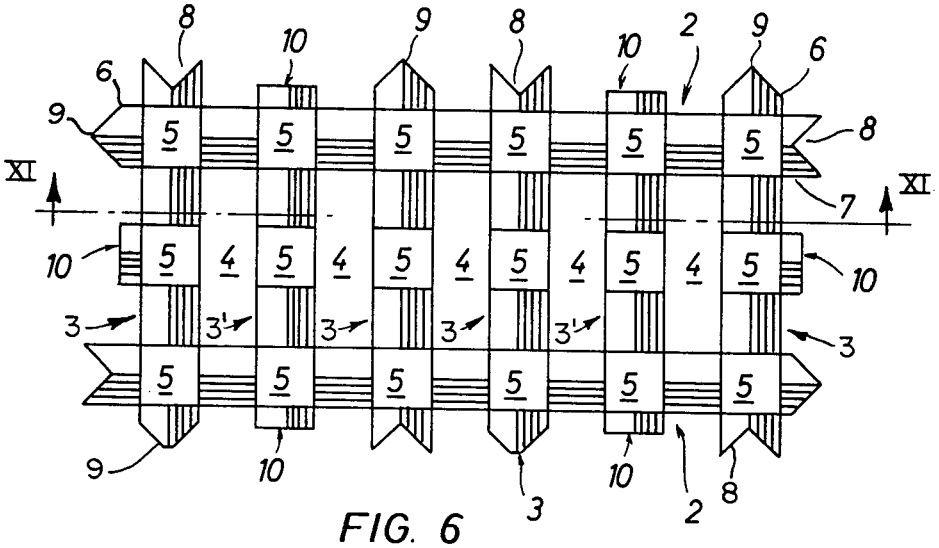
FIG. 6
FIG. 7
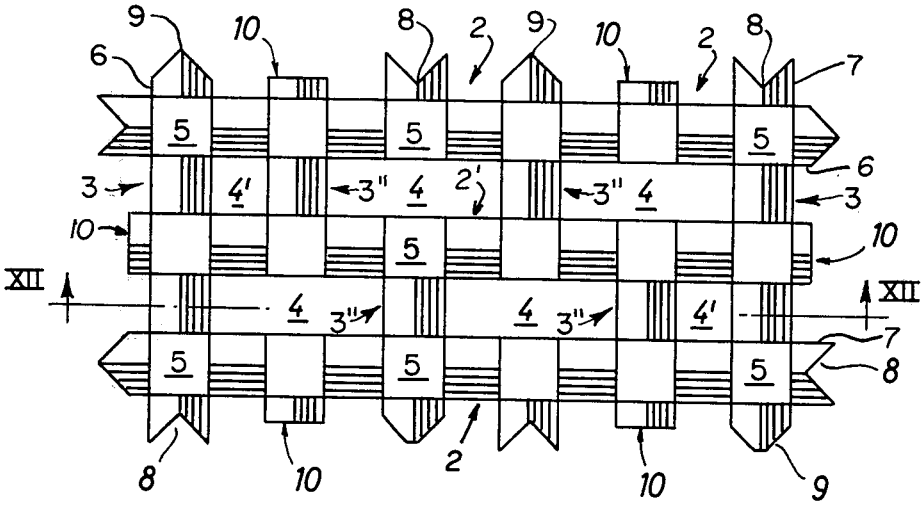

DECORATIVE STONE

The present invention relates to a decorative stone or tile, expecially a molded or formed concrete stone or tile, preferably for the fortification of sloping surfaces, such as embankments, banks, grades, or the like, which stone consists of parallelly disposed ribs and parallelly crosspieces with extend at right angles to each other with several of the ribs projecting beyond the outer crosspieces and several of the crosspieces extending beyond the outer ribs and with the projecting ends of the ribs and crosspieces being associated with grooves or recesses and/or tongues or projections receivable in the grooves. The grooves or tongues are formed by boundary surfaces extending vertically to the upper stone surface and are arranged in an alternate fashion about the periphery of the stone or tile.

Decorative stones of the aforementioned type are disclosed, for example, in German Pat. No. 1,962,841 and such tiles have three distinct advantages. A first advantage of such stones resides in the fact that a horizontal or inclined surface or embankment covered with decorative tiles appears as a grassy area if grass is sown in soil filling cavities formed between the crosspieces and ribs and cavities formed between adjacent stones. A second advantage resides in the fact that the stones are securely anchored in the ground and to one another by the root matting of the sown grass and also secured against displacement by interlocking between adjacent tiles. The third advantage resides in the fact that the individual stones can be associated with other stones no matter how they are grasped or seized when installed without the need for contemplating how one stone is to be added to the other stones whereby not only is the laying time for covering a specific area reduced but also the labor costs to be expended for the entire laying job.

Although conventional tiles such as disclosed in the aforementioned German Patent have proven themselves satisfactory when laid on sloping surfaces, tests conducted under conditions stricter than those heretofore encountered in actual practice have shown that there is a danger of undermining of the cavities which exist between adjacent stones. Also, the hollow spaces lying between the crosspieces and ribs of the individual tiles are undermined but not to as great an extent as the cavities between adjacent stones.

The present invention is concerned with the task to provide a decorative stone or tile which eliminates the aforementioned shortcomings encountered in the prior art.

The underlying problems encountered in the prior art are solved according to the present invention by further developing the tiles of the aforementioned type so that the undermining especially of the hollow spaced between adjacent stones is prevented even under extremely harsh conditions.

According to one feature of the present invention, at least one extension which is shorter than the projecting ends of the externally disposed ribs and the projecting ends of the externally disposed crosspieces is arranged between such projecting ends with the end face of the extension being disposed in parallel to the vertical extension plane of the crosspieces and ribs, respectively. Experiments with this type of construction have shown that by virtue of this arrangement an undermining of the hollow spaces or cavities between adjacent stones can be prevented since the size of such spaces or cavities are reduced.

Preferably, it is advantageous according to the present invention to arrange the extensions so that they lie as a prolongation or extension of a respective crosspiece or rib in order to provide a regular pattern of the grassy surface on the embankment or slope; however, the extensions may be disposed at various positions along the outer ribs or crosspieces.

Accordingly, it is an object of the present invention to provide a decorative tile or stone which avoids by simple means the aforementioned shortcomings and drawbacks encountered in the prior art.

Another object of the present invention resides in a decorative stone or tile which is relatively simple in construction and therefore also relatively inexpensive.

A further object of the present invention resides in providing a decorative stone or tile which prevents an undermining of the hollow spaces or cavities formed between adjacent stones.

These and further objects, features and advantages of the present invention will become more apparent from the following description when taken in connection with the accompanying drawings which show, for the purposes of illustration only, several embodiments in accordance with the present invention, and wherein:

FIG. 4 is a top view of a decorative stone or tile in accordance with the present invention having a rectangular configuration and provided with eccentrically disposed extensions and elongated hollow spaces or cavities of various lengths arranged in a central zone of the stone;

FIG. 5 is a top view of a decorative stone or tile in accordance with the present invention having a rectangular configuration and provided with centrally disposed extensions and hollow spaces extending parallel to externally disposed ribs and transversely therebetween;

FIG. 6 is a top view of a decorative stone or tile in accordance with the present invention having a rectangular configuration and centrally arranged extensions with a plurality of hollow spaces extending between externally disposed ribs;

FIG. 7 is a top view of a decorative stone or tile in accordance with the present invention having a rectangular configuration and provided with centrally disposed extensions and hollow spaces mutually offset and of various sizes disposed parallel to externally disposed ribs;

Figure 1:
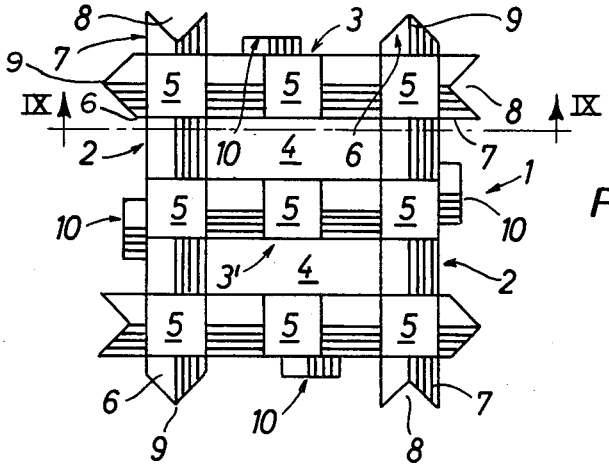
FIG. 1 is a top view of a decorative stone or tile in accordance with the present invention having a substantially square configuration and provided with eccentrically disposed extensions and elongated hollow spaces arranged in a central zone of the stone.

Referring now to the drawings wherein like reference numerals are used throughout the various views to designate like parts and more particularly to FIG. 1 wherein a decorative stone or tile generally designated by the reference numeral 1 is provided having a square configuration defined by two externally disposed ribs generally designated by the reference numeral 2 and two crosspieces generally designated by the reference numeral 3 which intersect and form the stone. The ribs 2 extend on both sides past the crosspieces 3 and the crosspieces 3 extend with their two ends beyond the ribs 2. A further crosspiece section 3' is disposed between the externally arranged crosspieces 3 thereby forming two elongated or oblong openings or hollow spaces 4 between the respective ribs and crosspieces. The top side of the decorative stone is configured so as to define nine square areas 5. The projecting ends 6 and 7 of the respective ribs 2 and crosspieces 3 are provided with grooves or recesses 8 and tongues or projections 9. The grooves and tongues are arranged in an alternating fashion about the periphery of the stone or tile and are adapted to matingly engage with corresponding grooves and projections provided on adjacent stones.

Figure 9:
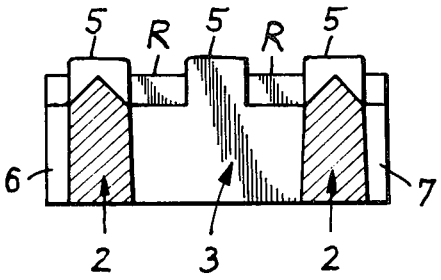
FIG. 9 is a cross-sectional view taken along line IX—IX of FIg. 1.

As shown most clearly in FIG. 9, the ribs 2 and crosspieces 3 as well as the crosspiece section 3' have a roof-shaped or gabled configuration between and/or on both sides of the areas 9 with the ridge line R of the gabled configuration extending in each case below the top side of the stone.

At least one extension portion 10 is arranged between the projecting ends 6, 7 of the externally located ribs 2 and between the projecting ends 6, 7 of the externally disposed crosspieces 3. The extension portions 10 are arranged eccentrically between the projecting ends 6, 7 on each side of the stone. As with the ribs 2 and crosspieces 3, extension portions 10 have a roof-shaped or gabled configuration. The extension portions 10 are shorter than the projecting ends 6, 7 of the ribs 2 and crosspieces 3 and are designated extensions since they need not be the projecting ends of the respective crosspieces 3 or ribs 2 or the crosspiece sections 3' or rib sections. Preferably, the axial length of the extension portions 10 is at least equal to the distance between the bottom of the groove or recesses 8 and the external surface portion of a respective rib 2 or crosspiece 3 whereby the end faces of the extension portions 10 are brought into abutting contact when the stones are assembled.

Upon installing the decorative tiles, the tiles are placed in contact with each other so that the tongues or projections 9 and the grooves or recesses 8 of the projecting ends of one stone engage the respective grooves or recesses and tongues or projections of the other stone whereby the end faces of the extension portions 10 of the two stones abut each other flush to thereby reduce the opening or space lying in the junction zone of the two stones by subdividing such opening or space into two openings which openings in the arrangement of FIG. 1 have differing sizes. As readily apparent the extension portions 10 may also have other axial lengths.

Figure 2:
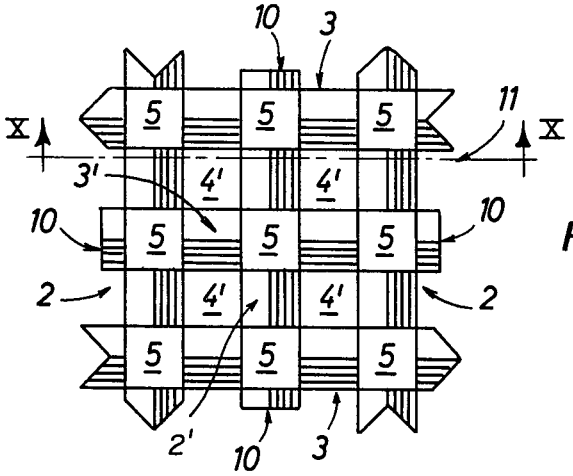
FIG. 2 is a top view of a decorative stone or tile in accordance with the present invention provided with centrally disposed extensions and four hollow spaces arranged in the central zone of the stone.

In FIG. 2, a decorative tile 11 is provided formed by two ribs 2 and two crosspieces 3 which define the periphery of the tile or stone. Each of the ribs 2 and crosspieces 3 are provided with either a tongue 9 or a recess 8 at the respective projecting ends thereof. Rib section 2' is provided and arranged so as to extend transversely to the crosspieces 3. A crosspiece section 3' is provided on each side of the rib section 2' and extends transversely to the ribs 2. A crosspiece section 3' and rib section 2' define four openings or cavities 4' in the central area of the tile or stone 11. The extension portions 10 are formed as an extension of the rib section 2' and/or the crosspiece section 3'.

Figure 8:
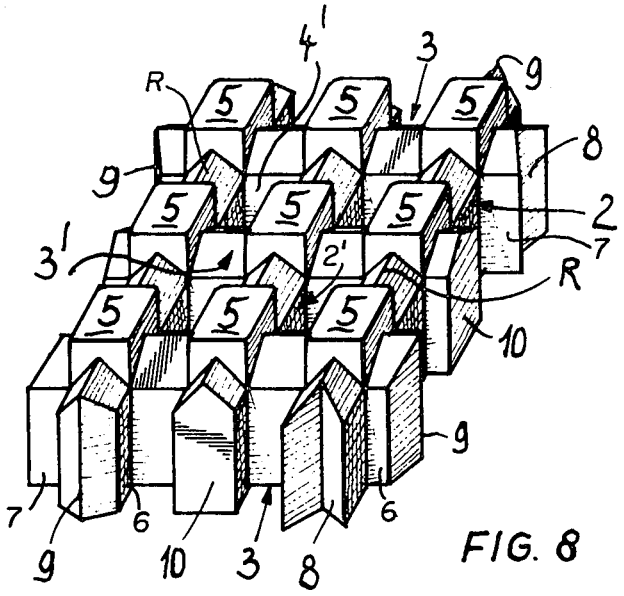
FIG. 8 is a perspective view of the decorative stone or tile illustrated in FIG. 2.
Figure 10:
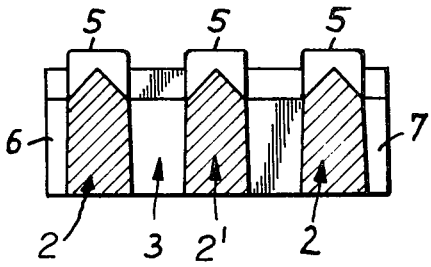
FIG. 10 is a cross-sectional view taken along line X—X of FIG. 2.

As shown most clearly in FIGS. 8 and 10, the configuration of the ribs 2, rib section 2', crosspieces 3, crosspiece section 3' and extension portion 10 of the tile 11 of FIG. 2 is the same as the configuration of such elements in the stone or tile of FIG. 1.

Figure 3:
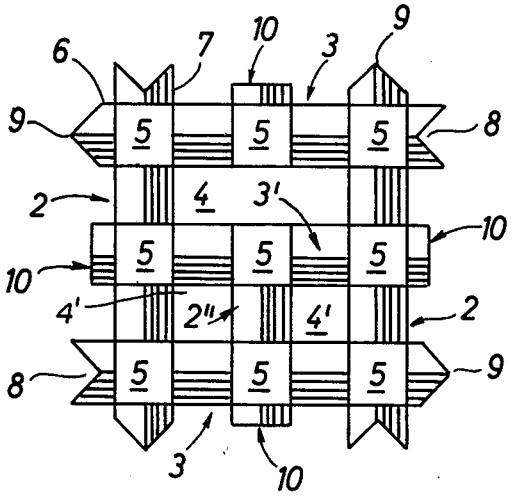
FIG. 3 is a top view of a decorative stone or tile in accordance with the present invention provided with eccentrically disposed extensions and three hollow spaces arranged in the central zone of the stone.

As shown in FIG. 3, by arranging a short crosspiece section 3' between the ribs 2 and a short rib section 2'' between one crosspiece 3 and the crosspiece section 3', a decorative tile results wherein the crosspiece section 3' forms an oblong or elongated cavity or opening 4 with one crosspiece 3 and forms two openings with the other crosspiece 3 and the short rib section 2''. As with the openings in the tile of FIG. 2, the two openings 4' in the tile of FIG. 3 are preferably of a substantially square configuration. In the tile of FIG. 3 the extension portions 10 are located centrally on the respective sides of the tile or stone and three of such extension portions may be formed as extensions of the crosspiece section 3' and rib section 2'.

As shown in FIG. 4, a stone or tile having a rectangular configuration is provided with two ribs 2 and crosspieces 3 defining the outer periphery of the stone. Furthermore, a rib section 2' is disposed substantially centrally of the outer ribs 2 with a short crosspiece section 3'' being disposed between the cross rib section 2' and the two outer ribs 3. On each short side of the stone an extension portion 10 is eccentrically arranged between the two projecting ends 6, 7 of the outer ribs 2.

The longer sides of the stone are preferably provided with at least one additional tongue 9 and recess 8 arranged in an alternating fashion with at least one extension portion 10 being eccentrically disposed between at least two of the adjacent tongue and recesses. Furthermore, on each long side either the tongue 9 or recess 8 is formed as a projecting end of the respective crosspiece sections 3'.

By positioning of the short crosspiece sections 3'' on each side of the rib sections 2' oblong or elongated spaces 4, 4'' of various lengths are defined between the ribs 2, short rib sections 2' crosspieces 3, and short crosspiece sections 3''.

Figure 13:
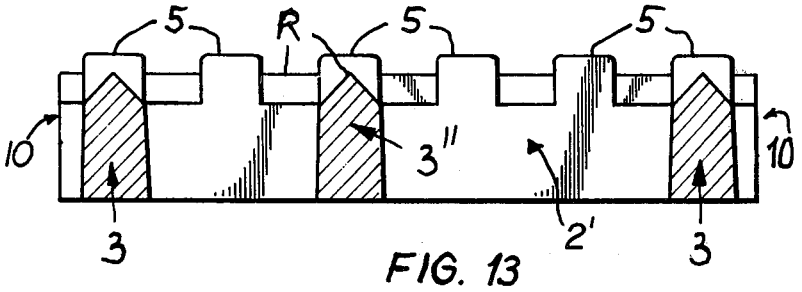
FIG. 13 is a cross-sectional view taken along line XIII—XIII of FIG. 4.

As shown in FIG. 13, the short ribs section 2, crosspieces 3, and short crosspiece sections 3'' have a roof-shaped or gabled configuration with a ridge line R provided between and/or on both sides of the square areas 5 forming the top side of the stone with the ridge line R extending below the top side of the stone.

The stone or tile of FIG. 5 is of a rectangular configuration defined by two ribs 2 and two crosspieces 3. A further pair of crosspieces 3 are provided and spaced from the outer crosspieces 3 and from each other. At least two rib sections 2' are provided and extend parallel to the outer ribs 2 at a position centrally thereof. Each of the rib sections 2' extend between an outer crosspiece 3 and an adjacent one of the further crosspieces 3. As with the embodiments described hereinabove each of the ribs 2 and crosspieces 3 are provided with projecting ends 6, 7 forming either tongues 9 or recesses 8. An extension portion 10 is disposed centrally of the projecting ends 6, 7 on each short side of the stone and preferably is formed as an extension of the rib sections 2'.

On the longer side of the stone each further crosspiece 3 extends beyond the outer rib 2 to form at least one additional tongue 9 and recess on each long side. At least one extension portion 10 is provided on each of the outer ribs 2 at a central position between at least two of the adjacent tongues 9 and recesses 8.

Figure 14:
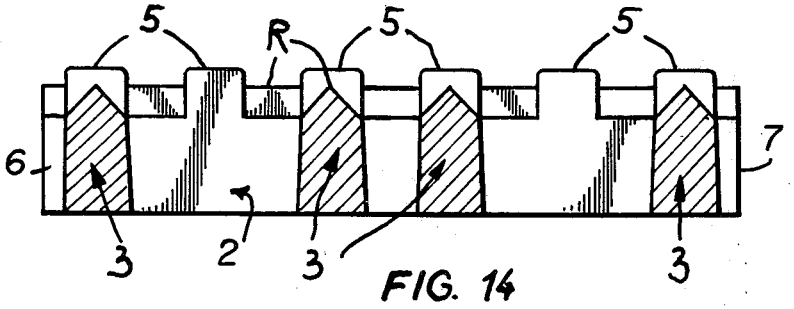
FIG. 14 is a cross-sectional view taken along line XIV—XIV of FIG. 5.

The arrangement of the ribs 2, rib sections 2', and crosspieces 3 results in a stone having at least five hollow openings or cavities 4 with four of the openings extending parallel to the outer ribs 2 and one of the openings extending transverse to the ribs 2. The cross sectional configuration of the various elements of the stone of FIG. 5 is shown in FIG. 14.

Figure 11:
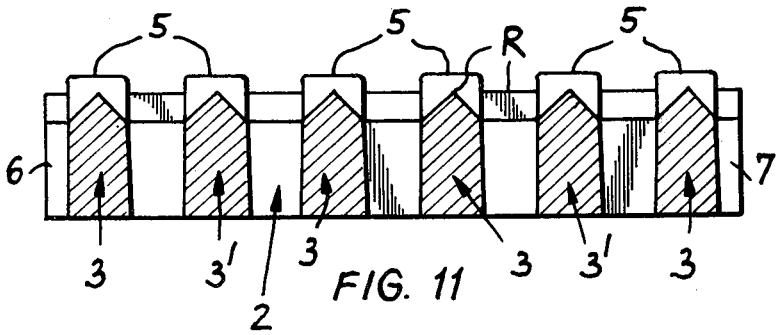
FIG. 11 is a cross-sectional view taken along line XI—XI of FIG. 6.

As shown in FIG. 6, a stone or tile is provided having a rectangular configuration defined by two ribs 2 and two spaced crosspieces 3 with two intermediate crosspieces 3 being provided and spaced from the outer crosspieces and from each other. Centrally disposed between each outer crosspiece and an intermediate piece is a further crosspiece section 3' which extends between the outer ribs 2 in parallel to the outer crosspiece 3 and intermediate crosspiece. On the short side of the stone at least one extension portion 10 is formed centrally of the projecting ends 6, 7 of the outer ribs 2. On the longer side of the stone at least one extension portion 10 is formed as an extension of each of the crosspiece sections 3'. The arrangement of the ribs 2, crosspieces 3, and crosspiece sections 3' result in a stone having five hollow spaces or cavities 4 each of which extend transversely to the outer ribs 2. As shown in FIG. 11, the configuration of the crosspiece sections and the top side of the stone is identical to that of the other stones discussed hereinabove.

As shown in FIG. 7, a stone or tile is provided which also has a rectangular configuration defined by two ribs 2 and two crosspieces 3 with a rib section 2' being interposed between the outer ribs 2 and extending between the crosspieces 3. Preferably, the rib section 2' is disposed centrally of the two outer ribs 2. On each short side of the stone at least one extension portion 10 is provided and disposed between the projecting ends 6, 7 of the outer ribs 2. Preferably the extension portion is formed as an extension of the rib section 2'. Several short crosspiece sections 3'' are provided and disposed on respective sides of the rib section 2' extending between such rib section 2' and the respective outer ribs 2 to define a number of oblong or elongated holes or cavities 4, 4' which are mutually offset and of various sizes.

On each long side of the rectangular stone at least one additional tongue 9 and recess 8 is provided between the projecting ends 6, 7 of the crosspieces 3 with the additional tongue 9 and recess 8 being arranged in an alternating fashion. The tongue 9 and recess 8 are spaced from the respective crosspieces 3 and from each other. At least one of the tongues 9 or recesses 8 on each long side is formed as an extension of the short crosspiece section 3'' with the other tongue 9 or recess 8 being arranged on the respective outer ribs 2.

Figure 12:
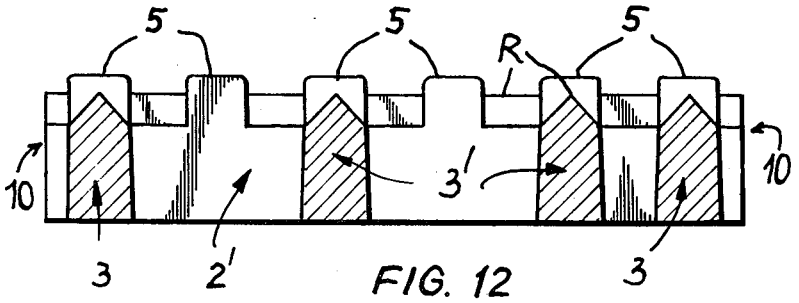
FIG. 12 is a cross-sectional view taken along line XII—XII of FIG. 7.

At least one extension portion is disposed centrally between at least two of the adjacent tongues 9 and recesses 8 on each long side of the stone with at least one of the extension portions 10 on each side being formed as an extension of the short crosspiece section 3''. The specific configuration of the ribs 2, crosspieces 3, and short crosspiece sections 3'' are identical to the earlier described stones as evident from an inspection of the cross-sectional view of the stone in FIG. 12.

In each of the stones or tiles of FIGS 4–7 the length of the narrow sides to the lengths of the long sides are of a ratio of 1:2 whereby these stones or tiles can then be laid in a composite with the stone or tiles of FIGS. 1–3. Accordingly, the lengths of the ribs 2 of the stones of FIGS. 4–7 are twice as great as great as the lengths of the ribs 2 of the first three embodiments. As readily apprent the axial length of each of the extension portions 10 of the stones or tiles of FIGS. 4–7 is at least equal to the distance between the bottom of the grooves or recesses and the external portion of the respective ribs 2 or crosspieces 3 whereby the end faces of the extension portions 10 are brought into abutting contact when the stones are assembled.

Furthermore, as apparent from an inspection of FIGS. 4–7, extension portions 10 are not located between all of the projecting ends of the crosspieces 3 and/or crosspiece sections 3'' and there normally are no extensions provided between the projecting ends of the crosspieces 3 arranged in the central zone of the longer sides of the rectangular stones.

While I have shown and described several embodiments in accordance with the present invention, it is understood that the same is not limitied thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A stone for use in forming a soil erosion preventing revetment having a plurality of stones 7 comprising at least two parallel rib members spaced from each other, at least two parallel crosspiece members spaced from each other extending transversely to said rib members and interconnecting at least the respective ends thereof, said rib members including end portions projecting beyond said crosspiece members at the point of connection therewith, said crosspiece members including end portions projecting beyond said rib members at the point of connection therewith, end surfaces on said end portions of said ribs and crossbars being formed with substantially corresponding projections and recesses alternating with each other on all sides of said stone and also from each side to the adjacent side so that said end portions on each side of said stone may be joined to end portions on any side of an adjacent stone, and at least one extension portion provided on said rib members and said crosspiece members disposed between the projecting end portions of said crosspiece members and between the projecting end portions of said rib members, said extension portions being shorter than said end portions so as not to interfere with the joining of the end portions of one stone with those on another stone, whereby undermining of the hollow space defined between said crosspiece members, and said rib members is prevented.

2. A stone according to claim 1, wherein said extension portions each terminate in an end face which extends parallel to a vertical plane in which said crosspiece members and said rib members extend.

3. A stone according to claim 1, wherein projections and recesses are formed by boundary surfaces extending vertically to an upper surface of the stone.

4. A stone according to claim 1, wherein said extension portions are eccentrically disposed between said projecting end portions of said crosspiece members and said rib members.

5. A stone according to claim 4, wherein a crosspiece section member is provided extending parallel to said crosspiece members and spaced therefrom, said crosspiece section member extending between and being connected to said rib members to define two openings in the stone separated by said crosspiece section member.

6. A stone according to claim 5, wherein said crosspiece section member is disposed midway between said spaced crosspiece members.

7. A stone according to claim 1, wherein a crosspiece section member is provided extending parallel to said crosspiece members and spaced therefrom, said crosspiece section member being extended between and connected to said rib members, and wherein a rib section member is provided extending parallel to said rib members and spaced therefrom, said rib section member extending between and connected to said crosspiece members, said crosspiece section member and said rib section member defining with said crosspiece members and said rib members four openings in the stones separated by said crosspiece section member and said rib section member.

8. A stone according to claim 7, wherein said extension portions are disposed midway between said projecting end portions of said crosspiece members and said rib members.

9. A stone according to claim 8, wherein said extension portions are formed as extensions of said crosspiece section member and said rib section member.

10. A stone according to claim 1, wherein a crosspiece section member is provided extending parallel to said crosspiece members and spaced therefrom, said crosspiece section member extending between and being connected to said rib members, and wherein a rib section member is provided extending parallel to said rib members and spaced therefrom, said rib section member extending from one of said crosspiece members to said crosspiece section member, said crosspiece members, said rib members, said crosspiece section members and said rib section members defining three openings in the stone separated by said crosspiece section member and said rib section member.

11. A stone according to claim 10, wherein some of said extension portions are formed as extensions of said crosspiece section member.

12. A stone according to claim 11, wherein at least one of said extension portions is formed as an extension of said rib section member.

13. A stone according to claim 12, wherein said rib section member is disposed midway between said spaced rib members.

14. A stone according to claim 1, wherein said rib members have a length which is twice the length of said crosspiece members.

15. A stone according to claim 14, wherein a rib section member is provided extending parallel to said rib members and spaced therefrom, said rib section member extending between and being connected to said rib members, and wherein at least two crosspiece section members are provided extending parallel to said crosspiece members and spaced therefrom, one of said crosspiece section members extending between and being connected with one of said rib members and said rib section member, the other of said crosspiece section members extending between and being connected with the other of said rib members, said crosspiece section members being spaced from each other and defining with said crosspiece members, said rib members and said rib section member forming four openings in the stone separated by said crosspiece section members and said rib section member.

16. A stone according to claim 15, wherein said extension portions provided between said projecting end portions are eccentrically disposed with respect to said end portions.

17. A stone according to claim 16, wherein said projections are V-shaped tongues and said recesses are V-shaped grooves having a configuration coordinated to said tongues, and wherein at least one additional projection and one additional recess is provided on each of said rib means spaced from each other.

18. A stone according to claim 17, wherein said additional recess is formed on an extension of said crosspiece section members.

19. A stone according to claim 18, wherein at least two extension portions are provided on each of said rib means.

20. A stone according to claim 19, wherein one of said at least two extension portions on each of said rib means is disposed between said projecting end portions of one of said crosspiece members and said groove means formed as an extension of said crosspiece section members.

21. A stone according to claim 20, wherein the other of said at least two extension portions on each of said rib means is disposed between said projecting end portions of the other of said crosspiece members and said additional tongue means provided on each of said rib members.

22. A stone according to claim 14, wherein two additional crosspiece members are provided extending parallel to said crosspiece members and spaced therefrom and from each other, said additional crosspiece members extending between said rib members and connected thereto, and wherein two rib section members are provided extending parallel to said rib members and spaced therefrom, each of said rib section members extending between a respective one of said pair of crosspiece members and one of said additional crosspiece members, said rib members, said crosspiece members and said rib section members defining five openings in the stone separated by said two rib section members and said additional rib members.

23. A stone according to claim 22, wherein at least two extension portions are provided on said rib members.

24. A stone according to claim 23, wherein one of said at least two extension portions is disposed between the projecting end portion of one of said pair of crosspiece members and said projecting end portion of one of said additional crosspiece members.

25. A stone according to claim 24, wherein the other of said at least two extension portions is disposed between the projecting end portion of the other of said pair of crosspiece members and the projecting end portion of the other of said additional crosspiece members.

26. A stone according to claim 25, wherein said extension portions provided on said crosspiece members are disposed midway between said projecting end portions of said rib members.

27. A stone according to claim 26, wherein said extension portions on said crosspiece members are formed as extensions of said rib section members.

28. A stone according to claim 14, wherein all of said crosspiece members including said additional crosspiece members are provided with end portions projecting beyond said rib members, and having complementary projections and recesses alternating with each other on each side of the stone so that they may be joined on any side to any side of an adjacent stone.

29. A stone according to claim 28, wherein said additional crosspiece members are provided with end portions projecting beyond said rib members, said last-mentioned projecting end portions being provided with means for facilitating the interconnection with other stones.

30. A stone according to claim 29, wherein at least two extension portions are provided on said rib members.

31. A stone according to claim 30, wherein one of said at least two extension portions is disposed between the projecting end portion of one of said pair of crosspiece members and said projecting end portion of one of said additional crosspiece members.

32. A stone according to claim 31, wherein the other of said at least two extension portions is disposed between the projecting end portion of the other of said pair of crosspiece members and the projecting end portion of the other of said additional crosspiece members.

33. A stone according to claim 32, wherein said extension portions provided on said crosspiece members are disposed midway between said projecting end portions of said rib members.

34. A stone according to claim 14, wherein at least one rib section member is provided extending parallel to said rib members and spaced therefrom, said rib section member extending between said crosspiece members and connected thereto, a first pair of crosspiece section members extending parallel to said crosspiece members and spaced therefrom and from each other, said first pair of crosspiece section members extending between said rib section member and one of said rib members, a second pair of crosspiece section members extending parallel to said crosspiece members and spaced therefrom and from each other, said second pair of crosspiece section members extending between said rib section member and the other of said rib members, said rib members, said crosspiece members, said rib section member and said crosspiece section members defining six openings in the stone separated by said crosspiece section members and said rib section member.

35. A stone according to claim 34, wherein at least two extension portions are provided on said rib members.

36. A stone according to claim 35, wherein one of said at least two extension portions on each of said rib means is disposed between a projecting end portion of one of said crosspiece members and said tongue means formed on said crosspiece section member.

37. A stone according to claim 36, wherein the other of said at least two extension portions on each of said rib means is disposed between a projecting end portion of the other of said crosspiece members and said additional groove means provided on each of said rib members.

38. A stone according to claim 37, wherein said extension portions provided on said crosspiece members are disposed midway between said projecting end portions of said rib members.

39. A stone according to claim 38, wherein said extension portions on said crosspiece members are formed as extensions of said rib section member.

40. A stone according to claim 39, wherein said extension portions on said crosspiece members are disposed midway between the projecting end portions of said rib members.

41. A stone for use in forming a soil erosion preventing revetment having a plurality of stones comprising: a pair of parallel rib members spaced from each other, a pair of parallel crosspiece members spaced from each other and extending transversely to said rib members and interconnecting the respective ends thereof such that said parallel rib members and said parallel crosspiece members define at least one opening therebetween, said pair of rib members including end portions projecting beyond said crosspiece members at the point of connection therewith, said pair of crosspiece members including end portions projecting beyond said rib members at the point of connection therewith, said projecting end portions of said rib members and said crosspiece members alternately having end surfaces formed with projections and recesses, said projections and recesses alternating on each side and from each side to its adjacent sides so that any side of the stone may be interengaged with any side of a further stone and being arranged such that when the stone is arranged with further stones, a hollow space is defined between adjacent stones, with at least one extension portion extending into the hollow space provided on said rib members and said crosspiece members disposed between the projecting end portions of said crosspiece members and between the projecting end portions of said rib members to prevent an undermining of the of the hollow space defined between adjacent stones.

42. A stone according to claim 41, wherein said extension portions are eccentrically disposed between said projecting end portions of said crosspiece members and said rib members.

43. A stone according to claim 41, wherein a crosspiece section member is provided extending parallel to said crosspiece members and spaced therefrom, said crosspiece section member extending between and being connected to said rib members to define two openings in the stone separated by said crosspiece section member.

44. A stone according to claim 43, wherein said crosspiece section member is disposed midway between said spaced crosspiece members.

45. A stone according to claim 44, wherein said extension portions are eccentrically disposed between said projecting end portions of said crosspiece members and said rib members.

46. A stone according to claim 44, wherein said extension portions are formed as extensions of said crosspiece section member and said rib section member.

47. A revetment useful in preventing soil erosion, having a plurality of stones, each stone comprising at least two parallel rib members spaced from each other, at least two parallel crosspiece members spaced from each other extending transversely to said rib members and interconnecting at least the respective ends thereof, said rib members including end portions projecting beyond said crosspiece members at the point of connection therewith, said crosspiece members including end portions projecting beyond said rib members at the point of connection therewith, end surfaces on said end portions of said ribs and crossbars being formed with substantially corresponding projections and recesses alternating with each other on all sides of said stone and also from each side to the adjacent side so that said end portions on each side of said stone may be joined to end portions on any side of an adjacent stone, and at least one extension portion provided on said rib members and said crosspiece members disposed between the projecting end portions of said crosspiece members and between the projecting end portions of said rib members, said extension portions being shorter than said end portions so as not to interfere with the joining of the end portions of one stone with those on another stone, whereby undermining of the hollow space defined between adjacent stones is prevented.

48. A revetment useful in preventing soil erosion, having a plurality of stones, each stone comprising: a pair of parallel rib members spaced from each other, a pair of parallel crosspiece members spaced from each other and extending transversely to said rib members and interconnecting the respective ends thereof such that said parallel crosspiece members define at least one opening therebetween, said pair of rib members including end portions projecting beyond said crosspiece members including end portions projecting beyond said rib members at the point of connection therewith, said projecting end portions of said rib members and said crosspiece members alternately having end surfaces formed with projections and recesses, said projections and recesses alternating on each side and from each side to its adjacent sides so that any side of the stone may be interengaged with any side of a further stone and being arranged such that, when the stone is arranged with further stones, a hollow space is defined between adjacent stones, with at least one extension portion extending into the hollow space provided on said rib members and said crosspiece members disposed between the projecting end portions of said crosspiece members and between the projecting end portions of said rib members to prevent an undermining of the hollow space defined between adjacent stones.

* * * * *